US006056605A

United States Patent [19]

Nguyen et al.

[11] Patent Number: 6,056,605

[45] Date of Patent: May 2, 2000

[54] CONTACT ELEMENT WITH CRIMP SECTION

[75] Inventors: Ngoc-Thach Nguyen, Grossbottwar; Helmut Bauch, Stuttgart; Gunter Meyer, Asperg, all of Germany

[73] Assignee: Robert Bosch GmbH, Stuttgart, Germany

[21] Appl. No.: 09/066,303

[22] PCT Filed: Sep. 9, 1996

[86] PCT No.: PCT/DE96/01684

§ 371 Date: Jun. 24, 1998

§ 102(e) Date: Jun. 24, 1998

[87] PCT Pub. No.: WO97/16867

PCT Pub. Date: May 9, 1997

[30] Foreign Application Priority Data

Oct. 28, 1995 [DE] Germany ..... 195 40 327
Dec. 30, 1995 [DE] Germany ..... 195 49 174

[51] Int. Cl.[7] ..... H01R 4/10

[52] U.S. Cl. ..... 439/882; 439/877

[58] Field of Search ..... 439/878, 882, 439/877, 880, 881

[56] References Cited

U.S. PATENT DOCUMENTS

| | | | |
|---|---|---|---|
| 3,549,786 | 12/1970 | Kuo | 439/877 |
| 4,077,698 | 3/1978 | Könnemann et al. | 439/882 |
| 4,242,535 | 12/1980 | Defibaugh et al. | 439/882 |
| 5,425,662 | 6/1995 | Villeneuve | 439/882 |

*Primary Examiner*—Gary F. Paumen
*Assistant Examiner*—Katrina Davis
*Attorney, Agent, or Firm*—Kenyon & Kenyon

[57] ABSTRACT

To reduce the risk of breakage and yet ensure good electric and thermal conductivity, pull-off strength and long service life of the connection, when connecting a contact element to a conductor (1) by crimping, the inner surface of the crimp section (6), in contact with the conductor (1), is provided with deformations that are grooves (2) and ribs running crosswise and obliquely to the longitudinal axis of the conductor (1).

6 Claims, 2 Drawing Sheets

CONTACT ELEMENT WITH CRIMP SECTION

FIELD OF THE INVENTION

The present invention relates to a contact element with a crimp section for conductors, with deformations on the inner surface of the crimp section provided for contact with the conductor.

BACKGROUND INFORMATION

Electric wires and cables with such contact elements, which exist in numerous forms as cable lugs, receptacles, or clamps, are used in different apparatuses and systems. Such contact elements allow a reliable and detachable electric connection to be quickly established. The advantage of crimp connections is that wires can be connected to the contact element using machines, resulting in a sufficiently stable, conductive connection between wire and contact element.

Efforts have continued to be made, however, to improve the connection between the electric conductor and the contact element concerning its electric and thermal conductivity, pull-off strength, service life, and resistance to corrosion so that it can withstand the effects of impacts, temperature fluctuations, moisture, corrosive atmospheres, or other extreme conditions. This would allow such connections to be used in new applications and make their operation in existing applications more reliable.

Thus, with conventional contact elements, there are depressions on the inside of the crimp section, which is in tight contact with the wire or wire bundle after crimping. The wire is deformed during crimping and pressure is applied to the depressions, providing improved mechanical attachment. At the same time, corrosion layers and lacquer-type insulating material is removed from certain areas thus deformed of the wire surface. In most conventional contact elements, these depressions are grooves running perpendicularly to the longitudinal axis of the wire. With the webs between the grooves, crimping produces a plurality of annular channels on the wire. Thus, after crimping, the wire has a smaller diameter in the area of the annular channels and the risk of the wire being broken increases, which is obviously undesirable.

As described in U.S. Pat. No. 3,892,459, as many as possible small depressions are provided on the inside of the crimp section in other contact elements to obtain as large a contact surface as possible. This, however, has the undesirable result that the small depressions on the side walls of the crimp section are closed due to the deformation of the side walls before the wires can be pressed into the depressions. U.S. Pat. No. 3,892,459 therefore describes that small, approximately square depressions may be provided on the bottom of the crimp section, which is only slightly or not at all deformed during crimping, and larger longitudinal depressions be provided on the side walls. The longer dimension of these longitudinal depressions extends perpendicularly to the longitudinal axis of the wire. Thus also in this case annular channels are formed on the wire, resulting in the aforementioned weakening of the wire and an increase in the risk of wire breakage.

U.S. Pat. No. 3,989,339 describes another conventional crimped connection using oblique channels and ribs.

Advantages of the invention

Upon crimping, each web between the grooves or each rib on the inner surface of the crimp section leaves a helical groove on the wire. Thus the cross section of the wire is reduced uniformly in comparison with the annular grooves in each longitudinal position located in the crimp section as compared to the conventional arrangement. The contact surface between contact element and wire is, however, much greater than that of the conventional contact element. This contact surface between contact element and wire can also be further increased by increasing the number of grooves and ribs, thus reducing the risk of breakage compared to the known crimp connections between contact element and conductor. With the increase in the contact surface, the electric and thermal conductance and, in particular, the mechanical strength are improved due to the crosswise arrangement of ribs and grooves. A preferable distribution of the reduction in the conductor's diameter is achieved when the grooves and ribs are arranged obliquely or helically in parallel to one another.

SUMMARY OF THE INVENTION

To increase the contact surface between crimp section and conductor according to this invention, two groups of grooves and ribs are provided obliquely to the longitudinal axis of the conductor as deformations, the grooves and ribs of one group running obliquely to those of the other group. The grooves and ribs of each group run parallel to one another and the grooves and ribs delimit diamond-shaped elevations and depressions, i.e., the grooves and ribs intersect one another at acute or obtuse angles that are preferably not equal to 90°.

The diamond-shaped elevations can preferably capped by pyramid-shaped vertices.

A further embodiment of the contact element according to the present invention is the use for insulated wires, in particular varnished wires with no prior insulation of the ends to be connected. By pressing the wire or the wires of a wire bundle into the grooves or the gaps between the ribs, the insulating layer or the varnish layer, and in addition any corrosion layer, is scraped off or pressed away by cutting into the sharp-edged linear elevations or by the vertices of the diamond-shaped elevations penetrating into the wires, and a good contact between wire and contact element is ensured. The operation of insulating can be omitted. Due to the crimped state of the grooves running helically, the material scraped off is removed to the outside at the time of crimping as it would be by a drill, and the bond between crimp section and wire is sealed at the edge of the crimp section, providing protection against the penetration of corrosive gases or liquids.

DETAILED DESCRIPTION OF THE INVENTION

Detailed Description of the Exemplary Embodiment

Figure 1:
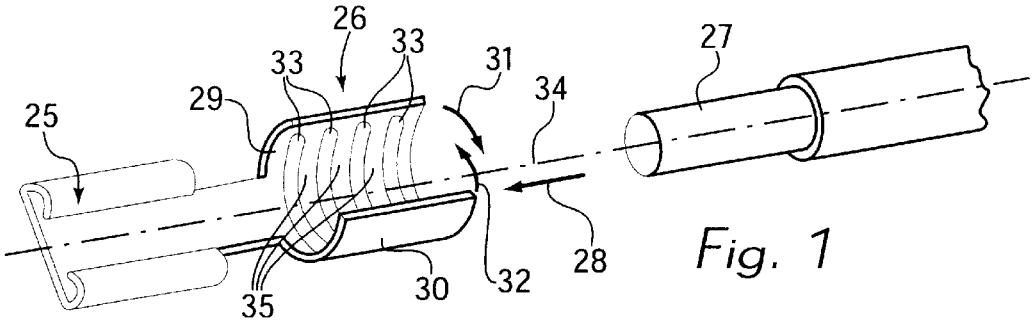
FIG. 1 shows a conventional contact element prior to crimping.
Figure 2:
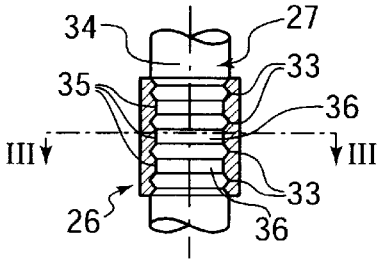
FIG. 2 shows a detailed cross section through a crimp section enclosing a wire after crimping for the contact element illustrated in FIG. 1.
Figure 3:
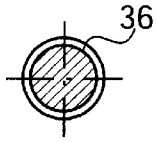
FIG. 3 shows the cross-section of a wire along III—III illustrated in FIG. 2.

FIG. 1 shows a conventional contact element prior to crimping with a conductor 27. At one end, the contact element has a plug-and-socket connector part 25, which can be pushed onto a flat contact plate to wire a machine or a part of a system. At the other end of the contact element, a crimp section 26 is provided, which has depressions in the form of grooves 33 extending perpendicularly to the longitudinal axis 34 of the conductor on its inner surface. Conductor 27 can be a single, solid wire or a braided cable and is pushed in the direction of arrow 28 into crimp section 26. Then crimping is performed, during which side walls 29, 30 of crimp section 26 are bent in the direction of arrows 31, 32. Conductor 27 is also deformed during crimping, being primarily pressed into grooves 33 and displaced by webs 35 between grooves 33. Webs 35 form annular grooves 36 on the conductor surface and thus reduce the conductor cross section in this area. FIG. 2 clearly shows annular grooves 36, produced by webs 35. FIG. 3 shows the section of the conductor in the area of an annular groove 36.

Figure 4:
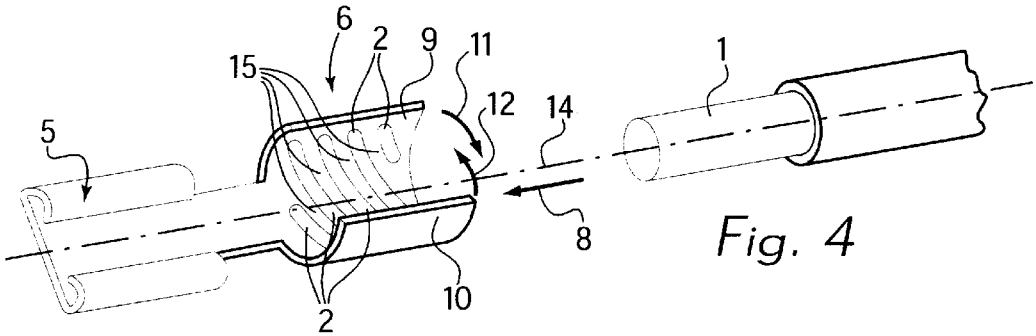
FIG. 4 shows another conventional contact element prior to crimping.
Figure 5:
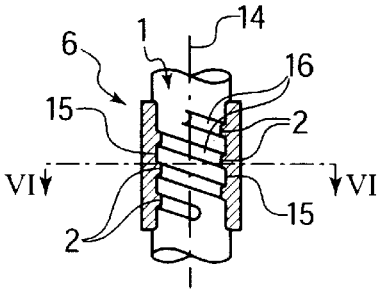
FIG. 5 shows a cross-section through a crimp section of a contact element illustrated in FIG. 4 enclosing a wire after crimping.
Figure 6:
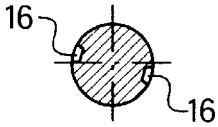
FIG. 6 shows the cross-section of the wire along VI—VI illustrated in FIG. 5.

FIG. 4 illustrates another conventional element. A conventional plug-and-socket connector part 5 is provided as a connecting option. Ribs 2, running obliquely to the longitudinal axis 14 of conductor 1, are provided on the inside of crimp section 6. If conductor 1 is pushed into crimp section 6 in the direction of arrow 8, and side walls 9, 10 of crimp section 6 are bent according to arrows 11, 12, ribs 2 separated by webs 15 form helical grooves 16 on the surface of conductor 1, the material of conductor 1 being displaced by the pressure applied during crimping toward webs 15 between ribs 2. The insulation or corrosion layers on the surface of the conductor may be scraped off due to the deformation of the conductor during crimping, so that a good electric and heat-conducting contact is created between conductor 1 and the contact element. The scraped-off insulation material or corrosion product is pressed outward in helical grooves 16 and seals the contact area between conductor 1 and crimp section 6 of the contact element against the penetration of corrosive gases and liquids. FIG. 5 shows grooves 16 running obliquely on the surface of wire 1. The cross section of conductor 1 shown in FIG. 6 is reduced to a much lesser degree than the cross section of the conductor illustrated in FIG. 3 in the area of an annular groove.

Figure 7:
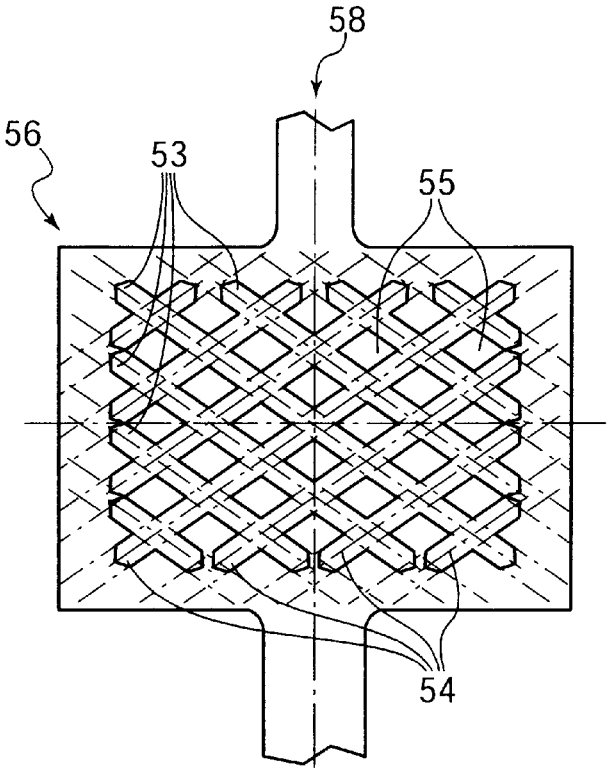
FIG. 7 shows a projection of a first crimp section embodiment of a contact element according to the present invention with a first group of parallel grooves and a second group of parallel countergrooves running obliquely to the grooves of the first group.
Figure 8:
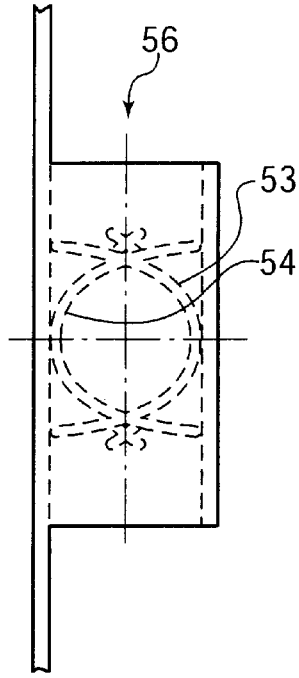
FIG. 8 shows a side view of the crimp section illustrated in FIG. 7 after crimping without showing the conductor, the dashed lines representing one of the grooves and one of the countergrooves inside the crimp section.
Figure 9:
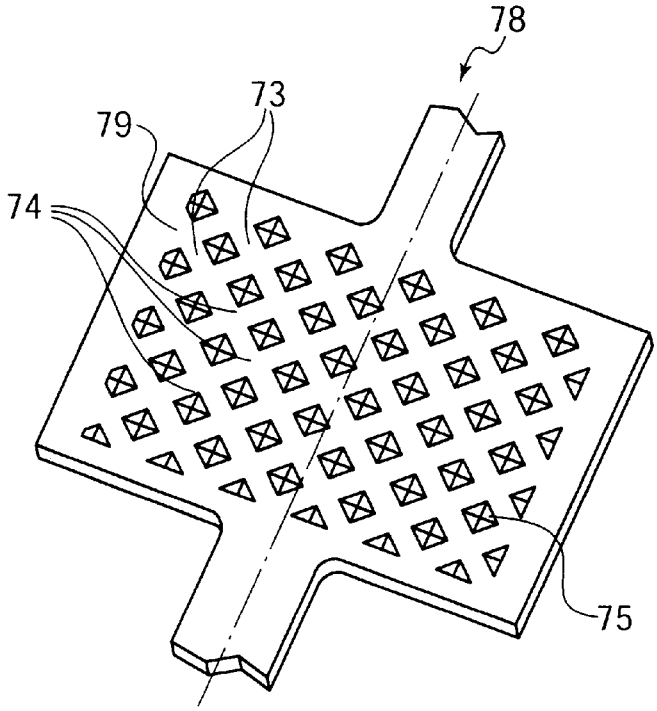
FIG. 9 shows another embodiment according to the present invention, which is manufactured by simple embossing or rolling or pressing from the back side.

FIGS. 7–9 show two embodiments of a crimp section according to the present invention. In the embodiment illustrated in FIG. 7, which shows a projection of crimp section 56 of a contact element from the inside, the inside surface of crimp section 56 has a group of grooves 53 and a second group of countergrooves 54. The grooves and countergrooves of each group run parallel to one another and both grooves 53 and countergrooves 54 run obliquely to the direction of insertion (arrow 58) and thus to the longitudinal axis of the conductor. As shown in FIG. 7, grooves 53 and countergrooves 54 form acute and oblique angles with one another, delimiting diamond-shaped elevations 55, which produce similar diamond-shaped depressions in the conductor during crimping. For reasons of strength, angles not close to 90° between grooves 53 and countergrooves 54 are preferred. FIG. 8 shows a side view of crimped crimp section 56. A groove 53 and a countergroove 54, running helically on the inside of the crimp section, are shown in dashed lines.

FIG. 9 shows elevations embossed crosswise in the form of diamond-shaped pyramids 75, with which the insulation layer can very easily be penetrated through high-pressure surface pressing. Elevations 75 are delimited by grooves 73, 74 running obliquely to one another and to the direction of insertion 78, grooves 73, 74 being flush with edge 79 of the crimp section.

What is claimed is:

1. A contact element comprising:

a crimp section having an inner surface; and deformations at the inner surface of the crimp section for contacting a conductor, the deformations including two groups of grooves and ribs, each of the two groups of grooves and ribs extending across the inner surface obliquely to a longitudinal axis of the conductor, wherein a first group of the two groups of grooves and ribs extends across the inner surface in a first direction, a second group of the two groups of grooves and ribs extending across the inner surface in a second direction and intersecting on the inner surface with the first group, the first direction being oblique to the second direction.

2. The contact element according to claim 1, wherein the grooves of one of the two groups extend parallel to the ribs of the one of the two groups.

3. The contact element according to claim 1, wherein the grooves are indented in the inner surface.

4. The contact element according to claim 1, wherein the grooves and the ribs of the two groups form diamond-shaped elevations and depressions.

5. The contact element according to claim 4, wherein the diamond-shaped elevations are capped by vertices.

6. The contact element according to claim 5, wherein the vertices have a shape of a pyramid.

* * * * *

UNITED STATES PATENT AND TRADEMARK OFFICE

CERTIFICATE OF CORRECTION

PATENT NO. : 6,056,605
DATED : May 2, 2000
INVENTOR(S) : Nguyen et al.

It is certified that error appears in the above-identified patent and that said Letters Patent is hereby corrected as shown below:

Title page,
Abstract,
Line 1, delete "...yet...".
Line 4, delete "...(1)...".
Line 5, delete "...(6)..." and "...(1)...".
Line 6, delete "...(2)...".
Line 8, delete "...(1)...".

Column 1,
Line 63, after "... and ribs." insert the following new paragraph -- One of the objects of the present invention is to provide a contact element which does not exhibit the aforementioned disadvantages of the related art and allows a connection between the contact element and the wire or wire bundle having improved electric and thermal conductivity, as well as improved twist-off and pull-off strength and resistance to corrosion.

This object is achieved by a contact element where the deformations are grooves and ribs that are transversally oblique to the longitudinal axis of the conductor. --.

Line 64, change "Advantages of the invention" to -- SUMMARY OF THE INVENTION --.

Column 2,
Line 1, delete "... in comparison with the annular grooves ...".
Line 18, delete "SUMMARY OF THE INVENTION".

Column 3,
Line 14, delete "Detailed Description of the Exemplary Embodiment".

UNITED STATES PATENT AND TRADEMARK OFFICE

CERTIFICATE OF CORRECTION

PATENT NO. : 6,056,605
DATED : May 2, 2000
INVENTOR(S) : Nguyen et al.

It is certified that error appears in the above-identified patent and that said Letters Patent is hereby corrected as shown below:

Column 4,
Line 34, change "... of grooves ..." to -- of continuous grooves extending over a substantial length of the inner surface --.
Line 34, change "... and ribs, ..." to -- and ribs defined between said two groups of grooves --.
Line 35, delete "... and ribs ...".

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*